United States Patent [19]

Hickin et al.

[11] Patent Number: 4,698,489

[45] Date of Patent: Oct. 6, 1987

[54] AIRCRAFT AUTOMATIC BORESIGHT CORRECTION

[75] Inventors: Charles W. R. Hickin, Binghamton; Gene Tye, Endwell, both of N.Y.

[73] Assignee: General Electric Company, Schenectady, N.Y.

[21] Appl. No.: 798,535

[22] Filed: Nov. 15, 1985

Related U.S. Application Data

[63] Continuation-in-part of Ser. No. 428,767, Sep. 30, 1982, abandoned.

[51] Int. Cl.[4] ..... G06F 15/58; F41G 3/30; F41G 5/26

[52] U.S. Cl. ..... 235/407; 89/41.21; 235/404; 364/423

[58] Field of Search ..... 235/400, 404, 407, 410, 235/411, 412; 364/423; 89/41 ME, 41 MA, 41.05, 41.06, 41.14, 41.17, 41.19, 41.21; 434/14.20, 22

[56] References Cited

U.S. PATENT DOCUMENTS

| | | | |
|---|---|---|---|
| 3,136,992 | 6/1964 | French | 89/41.21 |
| 3,798,795 | 3/1974 | Michelsen | 89/41.05 |
| 4,020,739 | 5/1977 | Piotrowski et al. | 89/41.06 |
| 4,099,719 | 7/1978 | Dean et al. | 235/411 X |
| 4,104,730 | 8/1978 | Morrison et al. | 235/410 X |
| 4,246,705 | 1/1981 | Lee | 434/22 |
| 4,308,015 | 12/1981 | Tye | 434/14 |
| 4,312,262 | 1/1982 | Tye | 235/412 X |
| 4,317,650 | 3/1982 | Lee et al. | 235/404 X |
| 4,402,250 | 9/1983 | Baasch | 235/412 X |

FOREIGN PATENT DOCUMENTS

| | | | |
|---|---|---|---|
| 1563094 | 3/1980 | United Kingdom | 89/41.19 |

*Primary Examiner*—Felix D. Gruber
*Attorney, Agent, or Firm*—I. D. Blumenfeld

[57] ABSTRACT

A boresight correction system is disclosed that determines the existing error between an aircraft gunsight and its gun systems while prescribed aircraft maneuvers are performed and which automatically corrects the gunsight system to compensate for this error. The system includes a sensor for detecting bullet positions, hardware that determines the bullet positions relative to the gun boresight, a digital processor to determine the above mentioned error, and to correct the gunsight system according to this error, and a non-volatile memory in the digital processor to store a corrected boresight position.

24 Claims, 14 Drawing Figures

VIDEO PROCESSING 36

WINDOW GENERATOR 240

AUTOMATIC BORESIGHT CORRECTION FLOW DIAGRAM

INITIALIZE ABC

AIRCRAFT AUTOMATIC BORESIGHT CORRECTION

BACKGROUND OF THE INVENTION

This is a continuation-in-part of application Ser. No. 428,767, filed Sept. 30, 1982, now abandoned.

This invention relates to aircraft gunnery boresight correction, and more particularly, to a system for effecting such gunnery boresight correction in an aircraft, automatically, upon the firing of several rounds of bullets, and while in flight, if so desired.

The concept of tracking projectiles to measure the alignment error between the primary target sensor of a fire control system and the associated gunnery is not new. U.S. Pat. No. 3,136,992—French, assigned to the assignee of the present invention, discloses an angle and range tracking radar to measure the positions of rounds fired from a turreted gun and to determine the alignment error between the radar and gun boresight axes. This system proved to be very effective for maintaining the alignment between the radar and the gun turret of a bomber defense fire control system and was produced in large quantities.

The use of a tracking radar is of little value, however, as a bullet sensor on a fighter aircraft where the primary target sensor is the pilot looking through a head-up display (HUD). It is essential, in this case, that the error between the HUD sighting or aiming reference and the observed bullets be measured in the visible, or near visible, portion of the electromagnetic spectrum.

Methods for boresighting which require that the pilot be the primary sensor of error between actual and simulated rounds or bullets have been tried in flight tests and have not proven successful. The principal difficulty with this approach is that the information is displayed for such a short period that the pilot cannot make a sufficiently accurate estimate of the error and then make an appropriate adjustment of the boresight without numerous repetitions, each of which consumes precious time and large amounts of ammunition.

As presently practiced, an accurate and stable alignment between the gun and gunsight on operational fighter aircraft is difficult to maintain over periods of several months without expensive and time-consuming methods involving considerable ground support equipment and skilled technicians. Misalignment between the gun and the gunsight results from movement due to different expansion coefficients of materials within the aircraft, bending moments acting on the aircraft in flight, drift in display electronics, forces and moments due to gunfire, and the large force disturbances that occur with repeated landings and air combat training maneuvers.

Adding to the problem is the fact that there are no practical means for checking the alignment between the gun and the gunsight other than through live firing of the gun. The firing of live ammunition into a gun butt on the ground is impractical in a war-time environment, and very expensive and time-consuming in peace time. Occasional strafing of ground targets provides an indication of gross alignment errors, but is not sufficiently precise or reliable as a primary means of checking boresight alignment due to the difficulty in correlating aiming errors with miss-distances.

Consequently, a need exists for an accurate and reliable technique for boresighting aircraft gunnery making use of a minimum of time and expense in so doing.

OBJECTS OF THE INVENTION

It is, therefore, an object of the present invention to provide an automatic aircraft boresight correction system.

It is a further object of the present invention to provide such an automatic boresight correction system capable of making maximum use of existing aircraft equipment.

It is a still a further object of the present invention to provide such an automatic boresight correction system which is capable of compensating for boresighting errors in an aircraft with a minimum of time and a minimum of expense, especially relative to ammunition being fired.

It is a still further object of the present invention to provide an improved method for boresighting aircraft gunnery.

Other objects and advantages of the present invention will become apparent as the description thereof proceeds.

SUMMARY OF THE INVENTION

In accordance with the present invention, there is provided an automatic aircraft gunnery boresight correction system for use in an aircraft having a gunery system and a sighting system therefor. Included are a cockpit television camera for detecting the location at a given instant of bullets fired from the gunnery system and a head-up display (HUD) for displaying through the sighting system a boresight symbol representing a reference point from which the predicted instantaneous position of fired bullets is computed. A display processor is provided and includes a video processing section for extracting the relative positions of fired bullets and the boresight symbol from the camera signal and storing data representing the positions of both. The display processor further includes a digital processor which calculates a predicted trajectory or series of instantaneous positions which the fired bullets will take. These calculations take into account sensor data relating to the motion of the aircraft. The digital processor also computes the difference or error between the observed positions of the fired bullets and the predicted positions thereof. A corrected boresight position is calculated and the digital processor includes a non-volatile memory for storing the corrected boresight position. The digital processor is adapted to correct the aircraft sighting system according to the corrected boresight position.

The automatic boresight correction (ABC) system is activated when the aircraft pilot selects the system with a mode selector switch. At that time, the digital processor branches to the appropriate software stored in a program memory within the digital processor. The pilot performs a sequence of aircraft maneuvers in conjunction with firing bullets and a corrected boresight symbol is computed in the digital processor.

In another aspect of the present invention, there is provided a method for boresighting a gunnery system in an aircraft having a sighting system including a boresight symbol. The method includes the steps of: firing several rounds from the gunnery system; predicting the position of the fired rounds relative to the boresight symbol; computing the actual positions of the fired rounds; computing an error vector between the predicted positions and the actual positions of the fired rounds; and correcting the sighting system to compensate for the error according to the error vector.

In yet another aspect of the present invention there is provided a method for automatically boresighting a gunnery system in an aircraft having a sighting system including a boresight symbol, the method including the following steps: firing several rounds from the gunnery system; predicting the trajectory of the fired rounds relative to the boresight symbol; determining the actual trajectory of the fired rounds; computing the error vector between the predicted trajectory and the actual trajectory of the fired rounds; and correcting the sighting system to compensate for the error according to the error vector.

In yet another aspect of the present invention there is provided a method for automatically boresighting a gunnery system in an aircraft having a sighting system including a boresight symbol, the method including performing two constant turn maneuvers and for each maneuver performing the following steps: firing several rounds from the gunnery system; determining the actual trajectory of the fired rounds; determining the best straight line of the trajectory (by averaging the bullet position centroid over a number of frames); then after the completion of the second maneuver solving the best straight lines for their instantaneous solution, that solution being the actual position of the aircraft boresight; and correcting the sighting system by replacing and previous position with this new boresight position.

BRIEF DESCRIPTION OF THE DRAWING

In the accompanying drawing:

FIGS. 4*a* to 4*f* shows the images that the pilot sees, for one mode of gunsight operation, in the gunsight optical system when there is no apparent system error;

FIGS. 5*a* to 5*f* shows the images that the pilot sees, in the same mode of gunsight operation as in FIG. 4, in the gunsight optical system with relative error existing between the predicted and actual bullet trajectories;

DESCRIPTION OF THE PREFERRED EMBODIMENT

Figure 1:
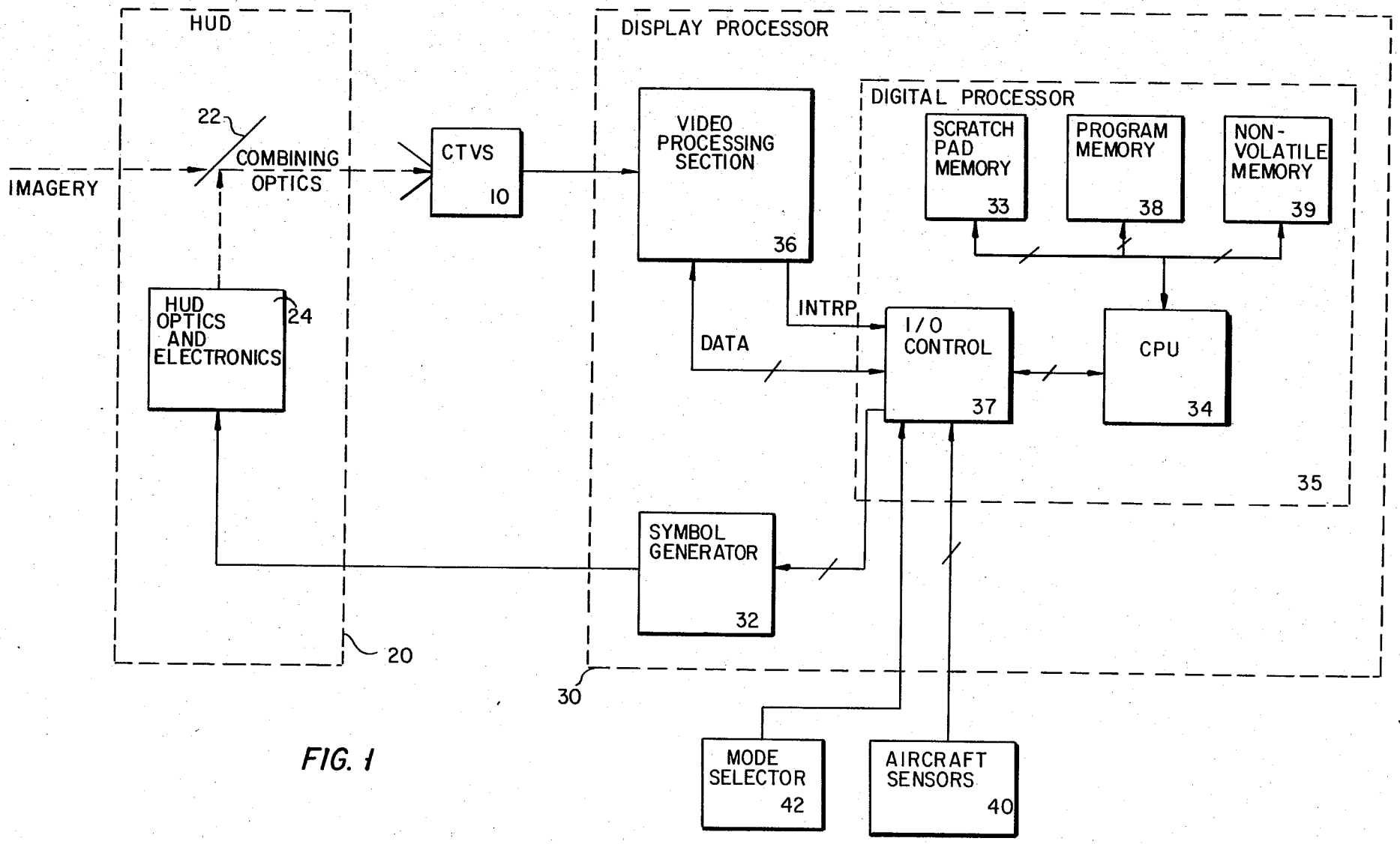
FIG. 1 shows in block diagram form the preferred embodiment of the aircraft automatic boresight correction system of the present invention.

In accordance with the present invention, and referring now to FIG. 1 of the drawing, there is shown in block diagram form the preferred embodiment of the automatic aircraft gunnery boresight correction system for use in an aircraft having a gunnery system and a sighting system therefor. A cockpit television sensor or camera, CTVS, 10 is provided for detecting the locations at a given instant of bullets fired from the gunnery system. A head-up display, HUD 20 is provided for displaying an aiming or boresight symbol representing a sighting reference point from which the predicted instantaneous positions of fired bullets is computed. HUD 20 includes a combining glass 22 and HUD optics and electronics 24.

The boresight symbol is generated in a display processor 30 by a symbol generator 32 which provides the input signal for HUD optics and electronics 24. The positioning of the boresight symbol is controlled by a digital processor 35, also contained within display processor 30.

A video processing section 36 is provided for extracting and storing data representing the positions of the fired bullets and the boresight symbol and is also part of display processor 30. Digitial processor 35 includes software for predicting a sequence of instantaneous points forming a path which the fired bullets will take. A system for predicting such a path is described in U.S. Pat. No. 4,308,015 to Tye, which is herein incorporated by reference. Digital processor 35 has a central processing unit, CPU 34, an input/output (I/O) control 37, and also includes a scratch pad memory 33, a non-volatile memory 39, and a program memory 38. Program memory 38 includes software for determining the difference or relative error between the observed positions of the fired bullets and the predicted positions thereof. A corrected boresight position, determined from the calculated error, is stored in non-volatile memory 39. In a preferred embodiment, the corrected boresight position is used in weapon delivery calculations to correct the sighting system. Alternatively, the calculated error could be used in weapon delivery calculations.

Figure 2:
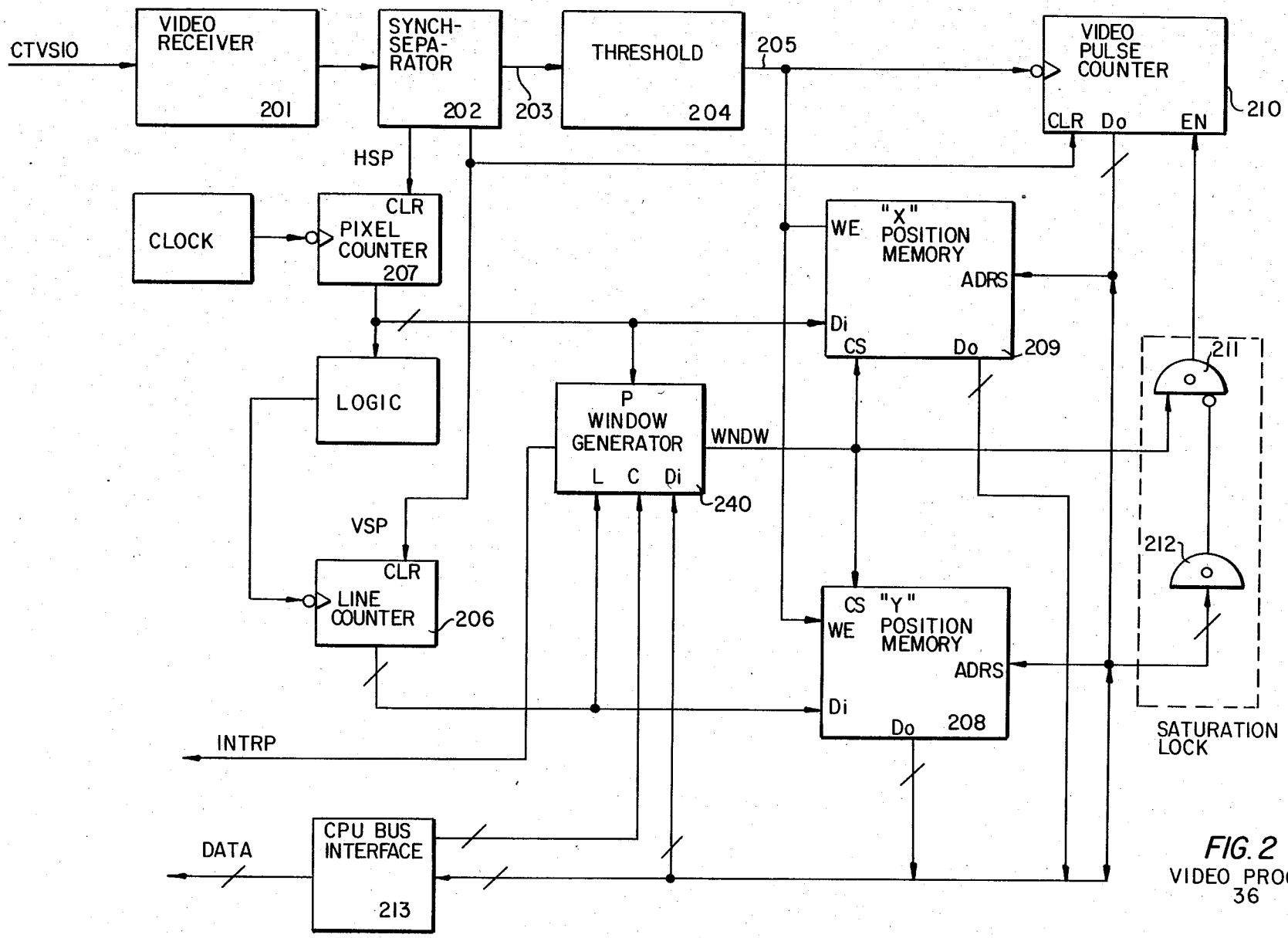
FIG. 2 shows, by schematic representation, the details of the video processing section of the display processor of FIG. 1.
Figure 3:
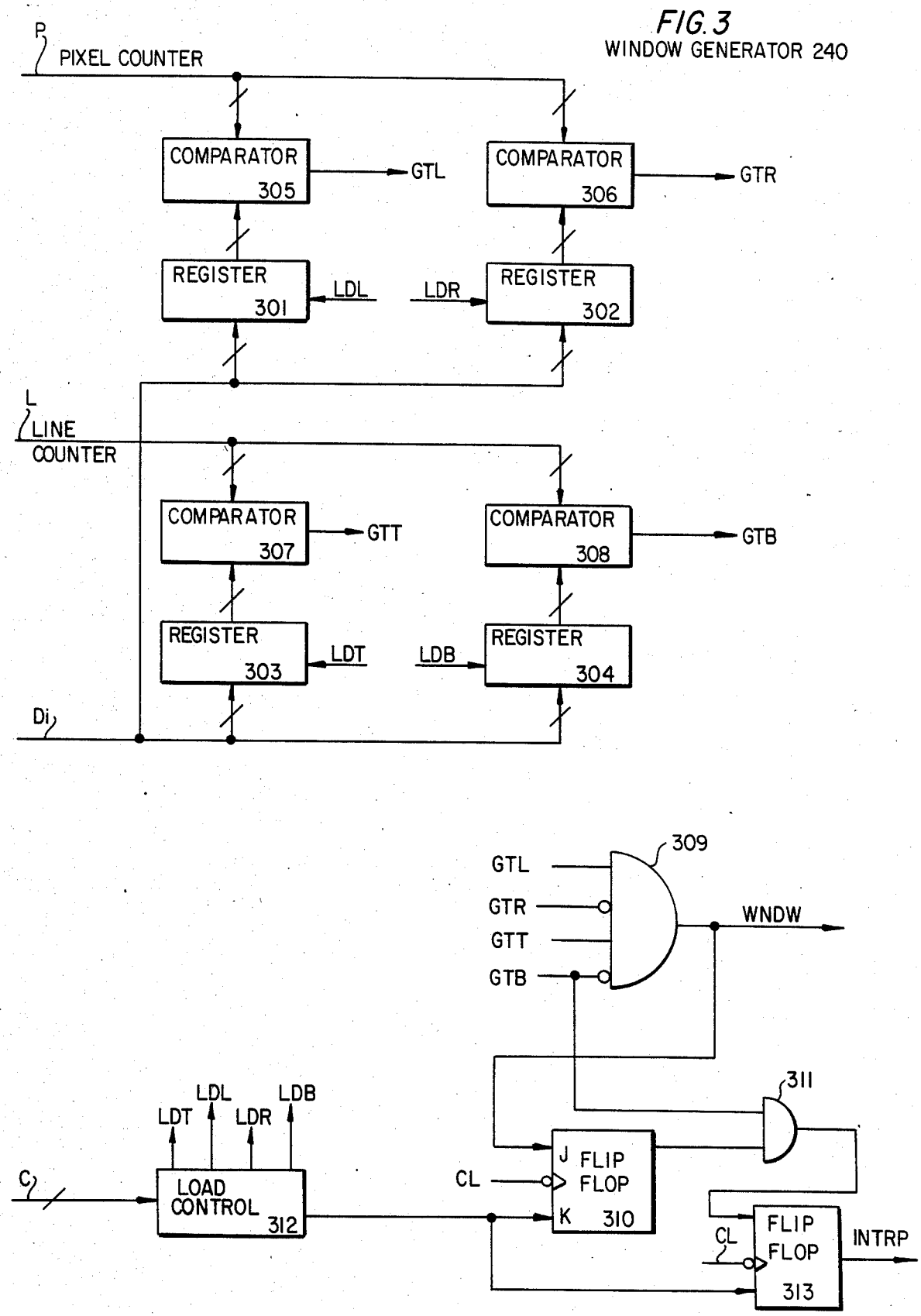
FIG. 3 shows, by schematic representation, further details of the window generator of the video processing section of FIG. 2.

The circuit of FIG. 1 operates as follows. For in-flight boresighting, the pilot selects the automatic boresight correction system on a mode selector switch 42, makes a turning maneuver and fires a short burst, preferably of tracer rounds. The burst is sensed by CTVS 10 and the fired bullets are tracked by the firmware of video processing section 36. Details of video processing section 36 are shown in FIGS. 2 and 3 and will be described hereinafter.

A sighting system without the automatic boresight correction of the present invention normally includes HUD 20, digital processor 35 and symbol generator 32, without non-volatile memory 39 and relative error calculation software in program memory 38. The elements of the sighting system function together to allow the pilot to visually aim at targets through HUD 20, using symbology generated by symbol generator 32, and manipulated by signals from CPU 34 using weapon delivery processing software in program memory 38. These manipulations take into account data received from a plurality aircraft motion sensors 40. This motion data reflects the instantaneous physical conditions of the aircraft at the time of firing, including the rates of aircraft roll, pitch and yaw, the aircraft lift acceleration, true aircraft airspeed, gun angle of attack, and relative air density. A method of making weapon delivery calculations based on such sensor data is described in the earlier-referenced Tye patent, U.S. Pat. No. 4,308,015. The symbology from symbol generator 32 is superimposed upon the real world image the pilot sees, through HUD 20, by optically projecting this symbology upon the HUD's combining optics 22.

An armament datum line (ADL), represented by cross 440 (FIG. 4), is used as the reference for this symbology. Due to many factors, as mentioned above, cross 440 may become misaligned with respect to the actual ADL. This misalignment can include the sight optics themselves. By using a relative positioning system that will realign cross 440 to the ADL by measuring the relative error between the actual ADL and the position of cross 440 and correcting for the same, all the absolute errors within the total system are compensated for. To do this, CTVS 10, video processing section 36, relative error processing software in program memory 38, and non-volatile memory 39 are added to form a closed loop that will null out error.

CTVS 10 employs raster scan techniques to generate the electronic signals (video) representing the images the observer sees through HUD 20. As the raster scan technique easily lends itself to matrix (X, Y) addressing of every point within the CTVS's field-of-view, every detected object within the image can be located by a matrix address. Therefore, cross 440 and all the objects seen by CTVS 10, including the bullets, can be assigned an address. Further, this address can represent positions, and as these positions will represent the positions of the objects, the system now has a means to measure (quantize) and compute positions, and positional differences between objects and symbols the camera sees.

Figure 5:
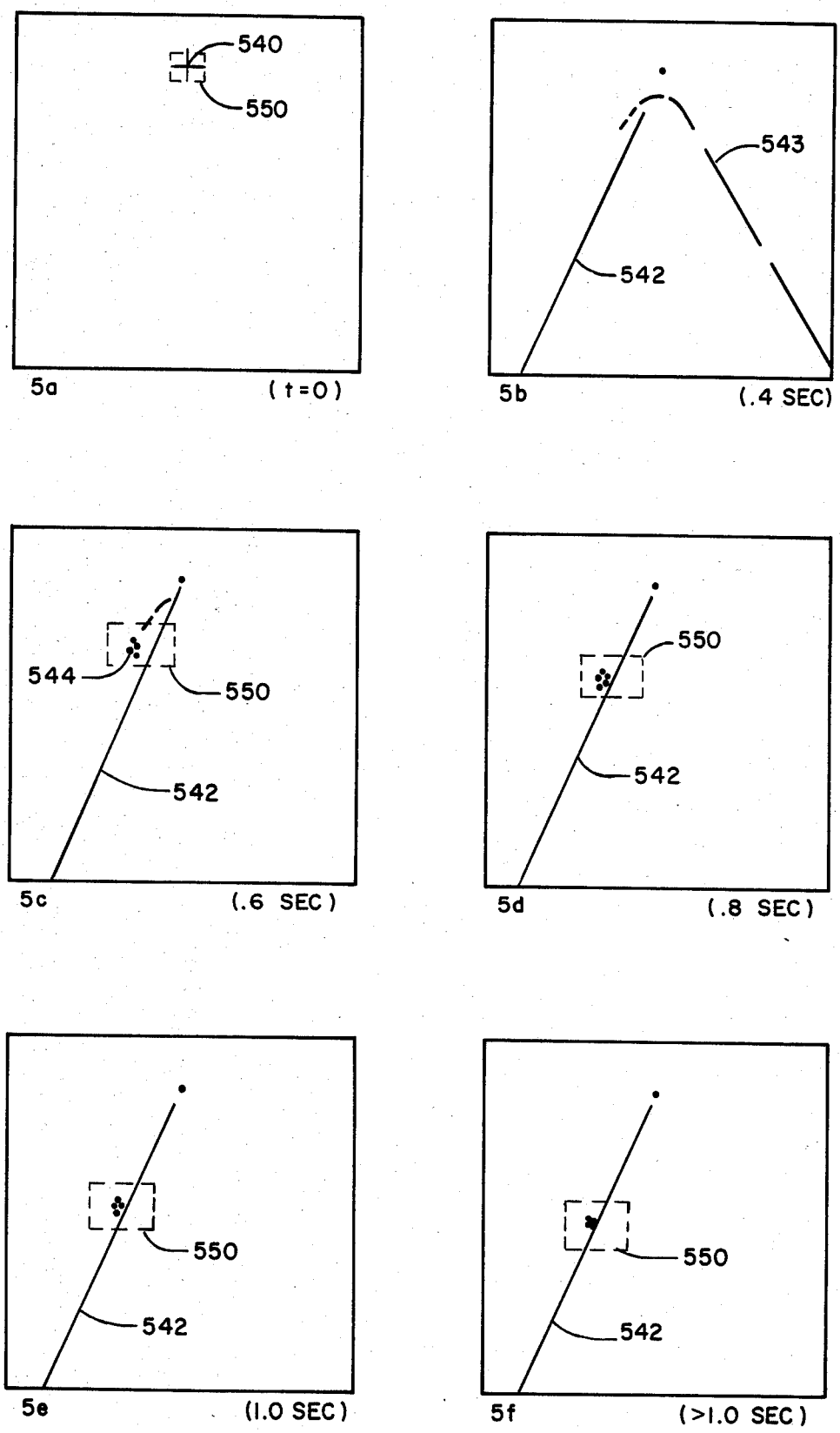
FIG. 5 comprising

Referring now to FIG. 2, a block diagram is shown of the preferred embodiment implementation of video processing section 36 which contains the hardware to detect the presence of the objects the camera sees by determining if the input camera video signal exceeds a preset threshold level. Video signals from CTVS 10 are reference to a DC voltage in a video receiver 201 to allow the separation of the horizontal and vertical synchronizing pulses (HSP and VSP) from the picture video in a sync separator 202. A picture video signal 203 is passed to a threshold circuit 204 where only video signals greater than a set threshold value are allowed to produce a threshold video pulse 205. The VSP and HSP condition a line counter 206 and a pixel counter 207, respectively, to allow a unique identification, or address, of each pixel within the video frame. The resolution of the address will be determined by the frequency of the clock generator. Upon receipt of threshold video pulse 205, the values of the line and pixel counter contents are stored in a Y position memory 208 and an X position memory 209, respectively, at their Di inputs. To prevent saturation of these memories from a plurality of video signals other than those believed to be from the bullets, an electronic window or tracker gate 550, shown in FIG. 5, is formed about the predicted bullet positions, of sufficient width and height to encompass any positional errors, by a window generator 240. Window generator 240 generates window boundaries with data from program memory 38 (of FIG. 1) and will allow only line counter values and pixel counter values that are within these bounds to be entered into memories 208 and 209. The position of the window is continuously computed during the gunnery interval to follow the path of the bullets.

A video pulse counter 210 is advanced by each threshold video pulse 205. The output of counter 210 is used (1) to sequentially address the memories for storing line and pixel counter 206 and 207 values that correspond to each threshold video pulse 205; and (2) to prevent an abundance of threshold video pulses 205 from exceeding the saturation limits of memories 208 and 209. A pair of logic gates 211 and 212 comprise a saturation lock which detects the saturation limit and prevents counter 210 from exceeding this saturation value by disabling video pulse counter 210. Video pulse counter 210 is enabled by the WNDW signal through gate 211 only when the raster scan is within the window bounds.

When line counter 206 exceeds the lower window boundary, window generator 240 generates an interrupt signal to CPU 34 by way of I/O control 37 (FIG. 1). Thus, for each raster field, the line and pixel data representing the threshold video pulse positions, and therefore the bullet positions within the CTVS field-of-view, are read from memories 208 and 209. This information is transferred by way of a CPU bus interface 213 and I/O control 37 into scratch pad memory 33 of digital processor 35 for relative error calculations.

FIG. 3 is a detailed schematic representation of the window generator 240 of FIG. 2, which will only allow events that occur within the bounds of window or gate 550 (of FIG. 5) to be recorded in memories 208 and 209. The values of the window's left, right, top and bottom boundaries are precomputed by digital processor 35 and stored with the aid of a load control 312 in four registers 301, 302, 303 and 304. The outputs of registers 301–304 are fed to the first inputs of four comparators 305 through 308, respectively. The value of pixel counter 207 is fed to the other inputs of comparators 305 and 306 and the value of line counter 206 is fed to the other inputs of comparators 307 and 308. When the values of line and pixel counters 206 and 207 are within the preset window bounds, appropriate comparisons are made by comparators 305 through 308. These comparisons are provided at the comparator outputs GTL, GTR, GTT, and GTB, i.e. greater than left, greater than right, etc. These output signals GTL, GTR, GTT, and GTB are logically combined by a logic gate 309 to produce the logic signal WNDW, that is used to enable memories 208 and 209 and video pulse counter 210. To maximize processing time, a circuit, comprised of a pair of flip-flops 310 and 313 and a gate 311, interrupts the digital processor immediately after the window's lower boundary is exceeded. Load control 312 generates pulses to reload registers 301 through 304 as DATA signals representing new window boundaries are received from digital processor 35. Load control 312 also resets interrupt logic circuits 310 and 313.

For a better understanding of the operation of these circuits, their operation during the raster frame will be explained, where the bullets are predicted to be somewhere near the middle of the CTVS's field-of-view. The digital processor has computed the components of the window that surrounds this predicted point and sent them to window generator 240. The VSP and HSP clear counters 206 and 207, respectively, thus establishing the start of the new raster frame. The raster scan begins at the top of the CTVS's field-of-view. The counters begin counting and, as their values do not coincide with the range of values within the window, window generator 240 prevents (locks out) the recording of any signals representing objects by disabling the CS inputs of memories 208 and 209. When the values of counters 206 and 207 are within the range of values of representing the precomputed window, window generator 240 unlocks memories 208 and 209 by enabling the CS inputs. This allows the recording of the objects' positions by these memories, as described earlier. As the raster scan progresses down the image and exceeds the lower window boundary, the values of the counters will no longer coincide with the allowed range of values within window generator 240, and window generator 240 will lock the memories by removing the enabling signal to memories 208 and 209. When the scan exceeds the lower window boundary, window generator 240 will also generate an interrupt (INTRP) signal which is sent to digital processor 35 to allow it to take the data from memories 208 and 209. The data is read from these memories using standard "read" techniques of conventional computers by accessing the memory's addresses and data through CPU bus interface 213.

The window is used to eliminate extraneous data that will not represent objects of interest and cause unnecessary computer processing. It also is used to prevent saturation of memories 208 and 209, as are the saturation lock comprising logic gates 211 and 212 and video pulse counter 210.

The circuits shown in the block diagram of FIG. 2 are standard state of the art circiutry that is readily recognized by those skilled in the art. This is true of window generator 240 shown in FIG. 3.

Software in digital processor 35 is used to calculate a relative error between the computed bullet positions and the measured bullet positions, and the gun boresight position is corrected using this error. This error calculation is discussed below in detail in connection with FIGS. 13 and 14. The corrected boresight position is stored in non-volatile memory 39 for use in weapon delivery calculations.

Figure 6:
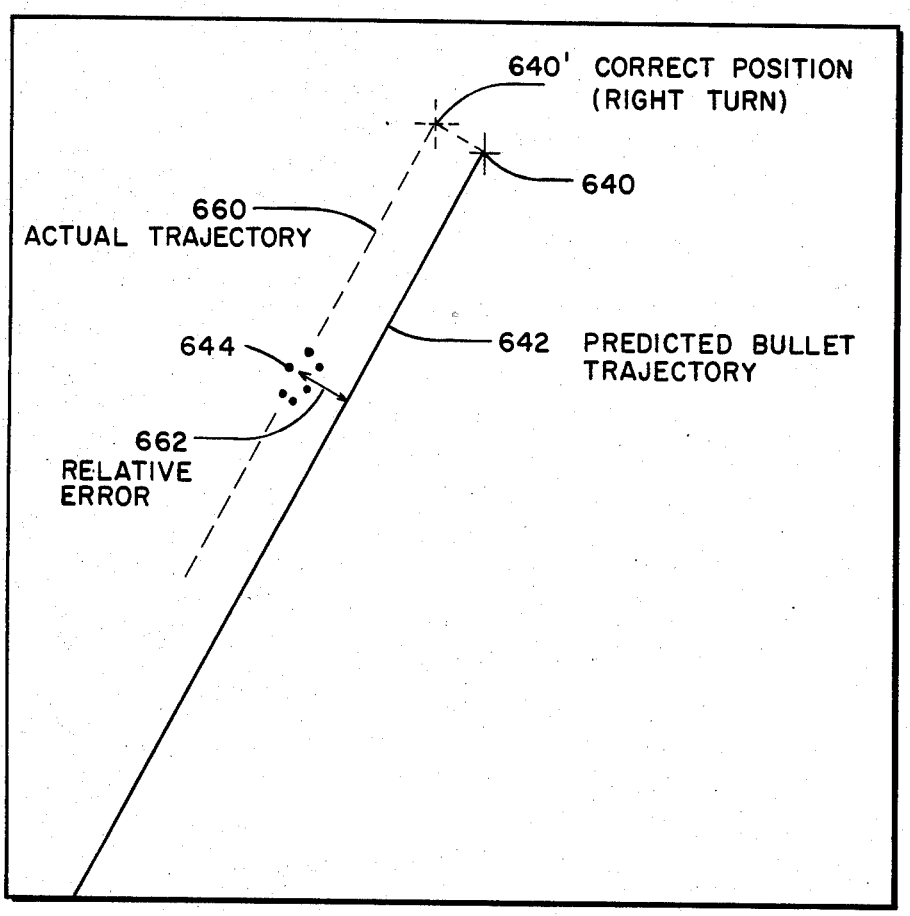
FIG. 6 shows more clearly and in more detail relative error for a given frame of FIG. 5 (e.g., 5*d*)

This process is further illustrated in FIGS. 5 and 6. The initial boresight symbol position on the combining optics of the HUD is determined relative to CTVS 10 to account for camera and HUD alignment. This is done using the relative error software in the processor which positions window 550 over the expected position of the boresight symbol. Video processing section 36 then detects the gun cross pixel positions in the video signal and stores them in the buffer comprising memories 208 and 209. These data are then used to compute the present boresight symbol position on combining optics 22 relative to CTVS 10. As seen in frame *5b*, the pilot has activated the ABC system, made a right turn and fired a short burst of tracer rounds. The pilot trigger pull is detected by digital processor 35 and an analytical bullet position calculation is begun using a bullet trajectory algorithm. For every camera field or raster scan of CTVS 10, window 550 is positioned at the predicted bullet position, as seen in frames *5c* through *5f*, and video processing section 36 detects the actual bullet positions relative to CTVS 10 combining optics 22 and stores them in the buffer.

Figure 9:
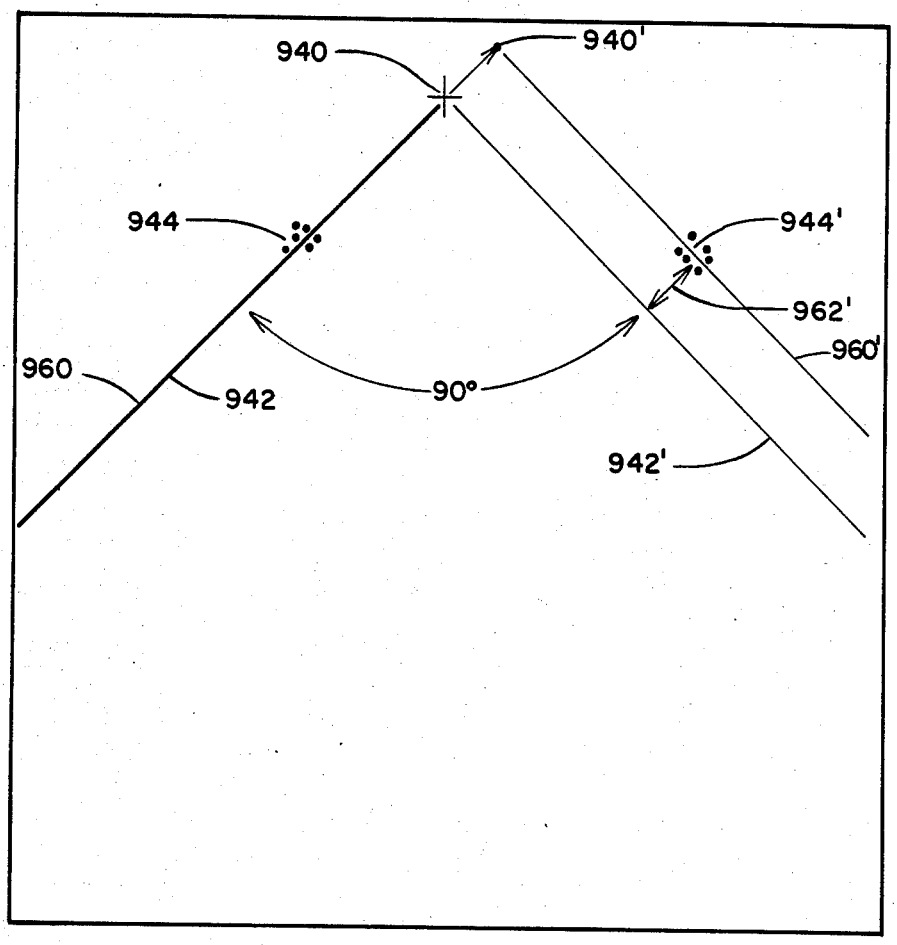
FIG. 9 shows a first, non-iterative method of boresight error correction.

As seen in FIG. 6, digital processor 35 uses these data to calculate the centroid of the bullet positions and compares this centroid with the theoretical bullet position normal to the direction of the bullet stream. This difference or relative error is averaged over each camera field and a corrected boresight symbol position is calculated for the entire burst. This calculation, however, will only correct boresight errors normal to the bullet trajectory. To get a two-axis correction, a turn in the opposite direction is required as shown in FIG. 9. This will yield a unique solution for the correction.

Referring to FIGS. 1 and 5, the data representing boresight cross 540 and bullets 544 are used by the relative error processing software in digital processor 35 to determine the relative error between the actual bullet trajectory and predicted trajectory as shown in FIG. 6. As cross 640 is the reference point for the predicted bullet path, the correction to its position is computed using relative error processing software and is stored in non-volatile memory 39. When this automatic boresight correction routine is disengaged, the loop is opened by bypassing the relative error calculations, and the corrected position of the cross 640 remains within non-volatile memory 39 to be used for all further gunnery computations.

Figure 4:
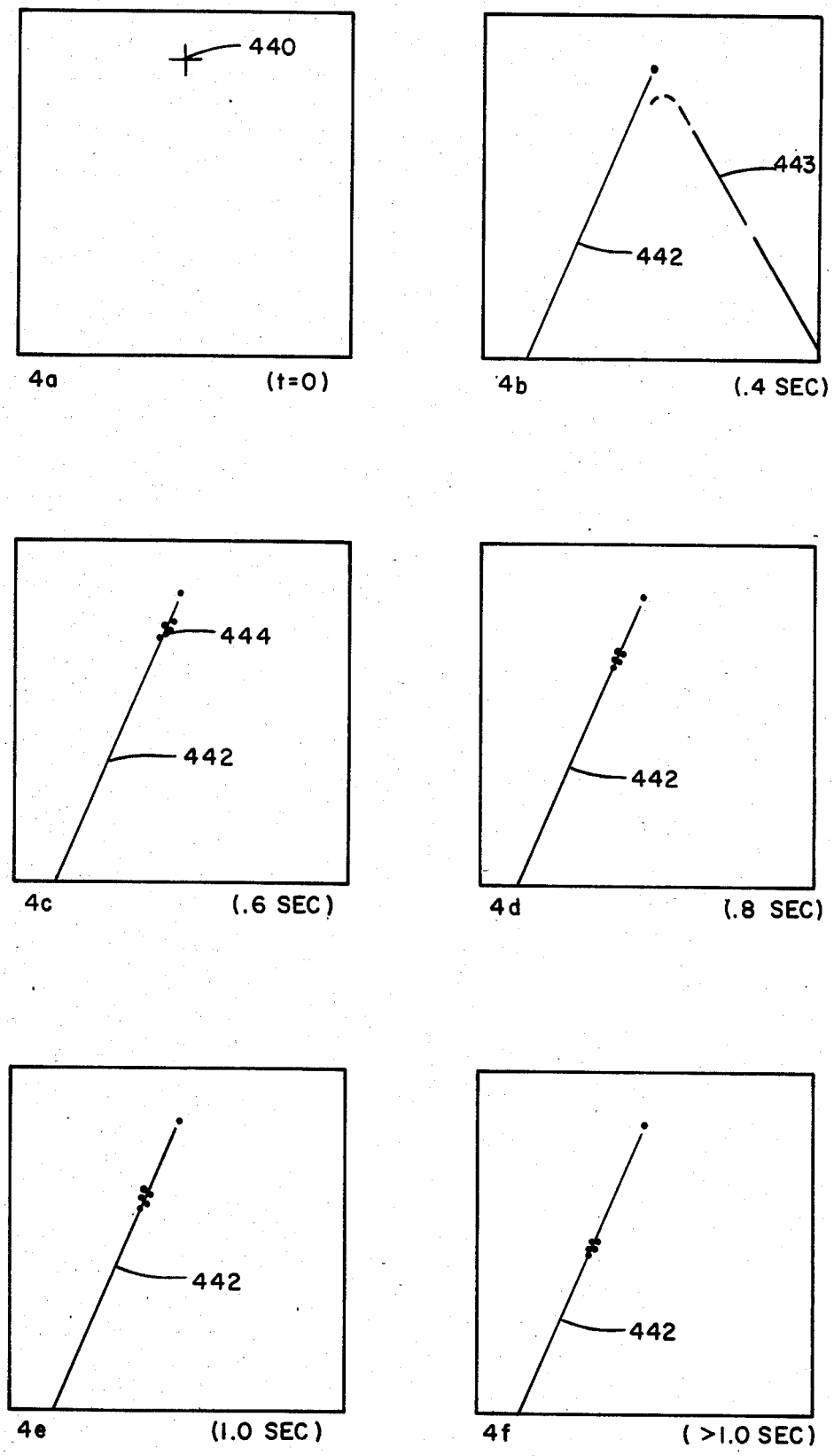
FIG. 4 comprising

Referring to FIGS. 4 and 5, a sequence of frames is shown that depicts the bullets positions as seen in the gunnery system's optical sight at various times throughout the bullets' flight for a given turn-rate of the aircraft from which the bullets were fired. Frames *4a* and *5a* depict the viewed or sensed position of boresight symbol 440 that represents the armament datum line of the aircraft. It is from this point that predicted bullet trajectory computations are made in digital processor 35, as depicted by the predicted bullet pitch lines 442 and 542 of frames *4b–4f* and *5b–5f*, respectively. These frames (*4b–4f* and *5b–5f*) show the image that the pilot and CTVS 10 would see, in one mode of gunsight operation, in the gunsight's optical system, at the time the gun trigger is actuated (frames *4b* and *5b*) and at later times (frames *4c–4f* and *5c–5f*). Each segment of the broken lines 443 and 543 is the actual trajectory of an individual bullet as it leaves the aircraft's gunnery and travels through the space near the aircraft as detected in each video frame from CTVS 10. On succeeding frames (*4c–4f* and *5c–5f*) the bullets appear as points 444 and 544 that appeat to drift or fall through space on each succeeding frame. The positions of these points are detected by CTVS 10 in combination with the video processing section 36 as previously explained, such information being further processed by the relative error processing software in CPU 34 to determine relative error of boresight symbol 440 (540) with respect to aircraft gun alignment. FIGS. 4 and 5 are essentailly the same except that FIG. 4 depicts the images when there is negligible error, while FIG. 5 depicts the images when appreciable error exists. FIG. 5 also shows the position and shape of electrontic window 550 at the time the gun trigger is activated (*5a*) and at succeeding times (or video frames *5c–5f*).

FIG. 6 depicts a given frame of FIG. 5, showing an increased relative error. As shown in enlarged view to illustrate the particular situation more clearly, the present position of boresight symbol 640 is depicted, as presently stored within digital processor 35, together with the true position 640' of the armament datum line at which the boresight symbol should be. (Note that the boresight symbol used in these drawings is a small cross.) A dashed line 660 represents the actual trajectory of the bullet's centroid when it is far enough ahead of the aircraft to eliminate parallax. Bullet trajectory line 660, when extended, will cross through the correct position 640' at which the boresight symbol should be.

Figure 7:
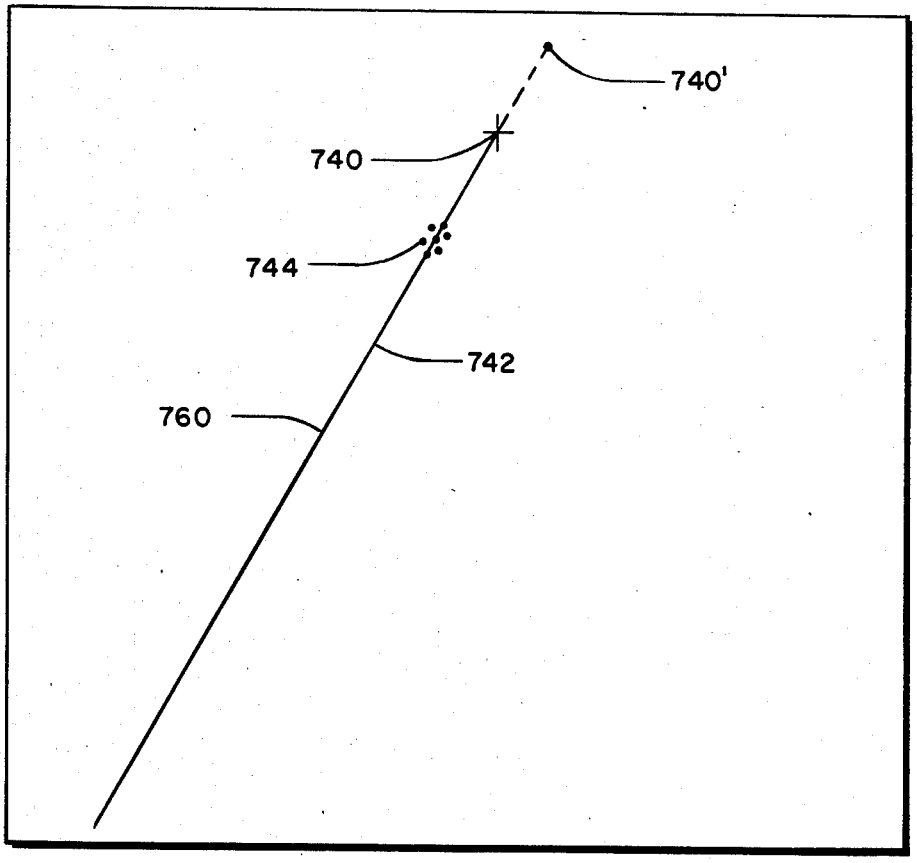
FIG. 7 shows a hidden relative error that may exist when the correct position of the boresight symbol lies on an extension of the predicted bullet trajectory line.

For certain situations, the relative error 662 may be hidden from the pilot and CTVS 10. This can occur, as depicted in FIG. 7, where position 740' of the correct boresight symbol lies in-line with the predicted bullet line trajectory 742. When this occurs, the bullet's centroid follows the predicted trajectory line 742 adn there is no apparent error. In this case, the predicted and actual bullet trajectory lines 742 and 760, respectively, coincide.

Figure 8:
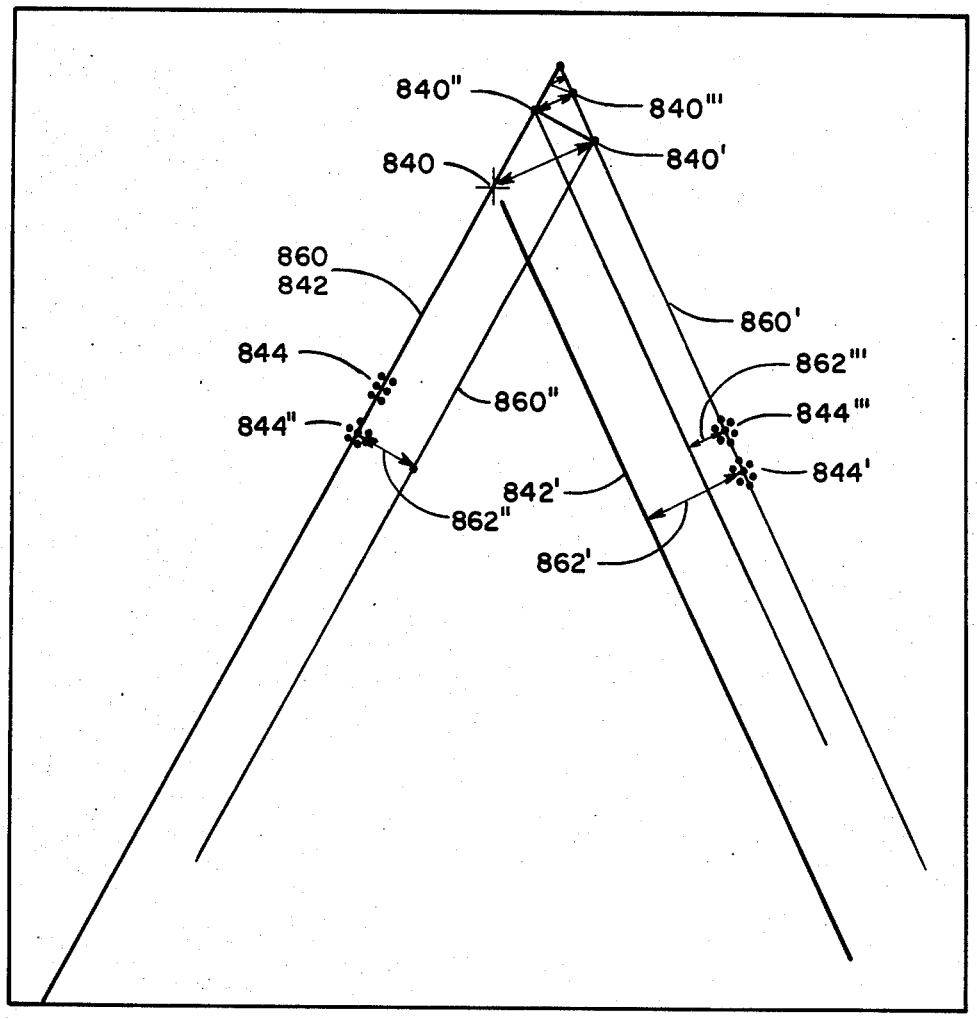
FIG. 8 shows the resulting corrections that occur when an iterative method of boresight error correction is used.
Figure 10:
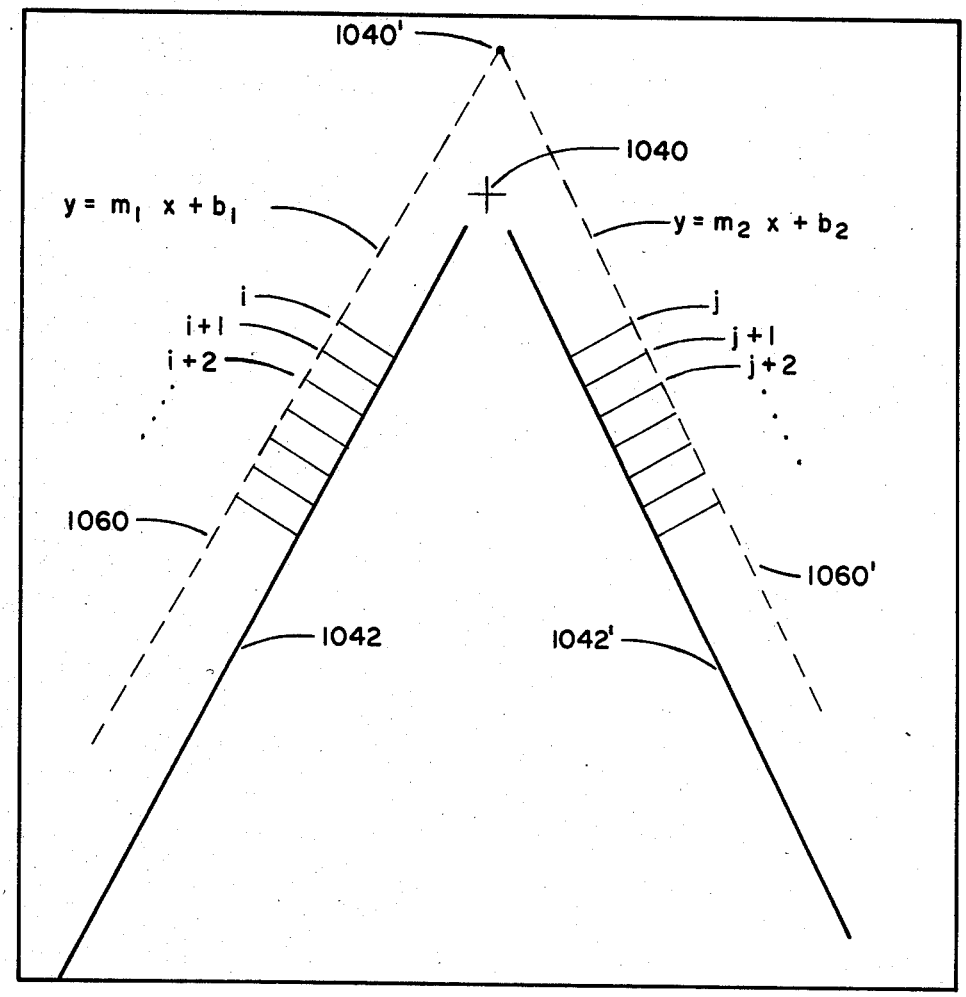
FIG. 10 shows a second, non-iterative method of boresight error correction.

Referring to FIGS. 8, 9 and 10, three different methods for determining relative error are depicted. Any one of these methods may be programmed in the preferred embodiment of the invention. FIG. 8 shows an iterative method by which the pilot flies a right turn, followed by a left turn, then a right turn, and so on. On each turn, a burst of rounds is fired and relative error is computed. On the first turn, the predicted 842 and actual 860 bullet trajectory lines coincide. There is no detected error and no correction is made. (This is the beginning of exemplify the hidden case depicted in FIG. 7). On the second turn, the relative error between the actual bullet trajectory line 860' and predicted bullet trajectory line 842' is clearly shown. A first correction is made by moving the boresight symbol perpendicular to the actual bullet trajectory line 860' by the computed relative error value 862' to a new position 840'. Again, on the third turn, the relative error is clearly shown between the actual 842 and the predicted 860'' bullet trajectory lines and a second correction is made by moving the boresight symbol perpendicular to the actual bullet trajectory line 842 by the relative error value 862'' to a newer position 840''. This process iterates until the error is of negligible value. In actual practice, only two turns are required.

FIG. 9 shows a non-iterative method by which the aircraft is flown in a first turn, the relative error is computed, and the boresight symbol's position is corrected by moving its position perpendicular to the actual bullet trajectory line as described for FIG. 8. This is followed by a second turn that is perpendicular to the first turn and then correcting the boresight symbol position in the same manner as just described. This results in a non-iterative solution whereby boresighting results from completion of the correction for the second turn.

A second, non-iterative method is shown in FIG. 10 whereby the aircraft is flown in a first turn, the bullets are fired, and the actual bullet trajectory line is determined and stored. The aircraft is then flown in a second turn that differs from the first turn, the bullets are fired, and again the actual bullet trajectory line determined. The two actual bullet trajectory lines defined by equations.

$$y=m_1x+b_1 \text{ and } y=m_2x+b_2$$

are solved using relative error processing software for their common solution which determines the correct boresight symbol position 1040'. In this method, it is not necessary to know the initial boresight symbol position 1040. The correct position of boresight symbol 1040' relative to the gunnery system is computed, rather than the relative error between the initial boresight symbol position 1040 and the correct boresight symbol position 1040'.

Also shown in FIG. 10 is averaging that can occur by solving for the centroid of the bullets at a number of points along the actual trajectory of the bullets, noted by i, i+1, i+2 . . . and j, j+1, j+2 . . . These solutions are possible for a number of video frames as depicted in FIGS. 4 and 5. The larger number of samples will allow the relative error processing software to obtain a more nearly accurate solution of the bullet's actual trajectory lines 1060, 1060'.

Figure 11:
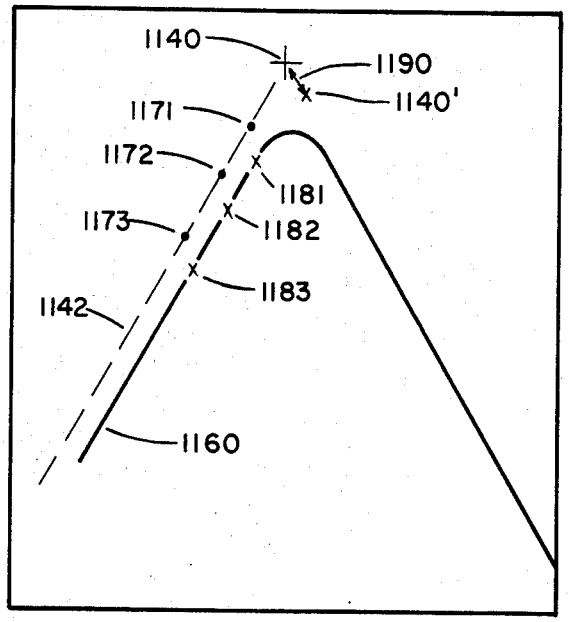
FIG. 11 shows a third, non-iterative method, one which uses time intervals for boresight error correction.
Figure 12:
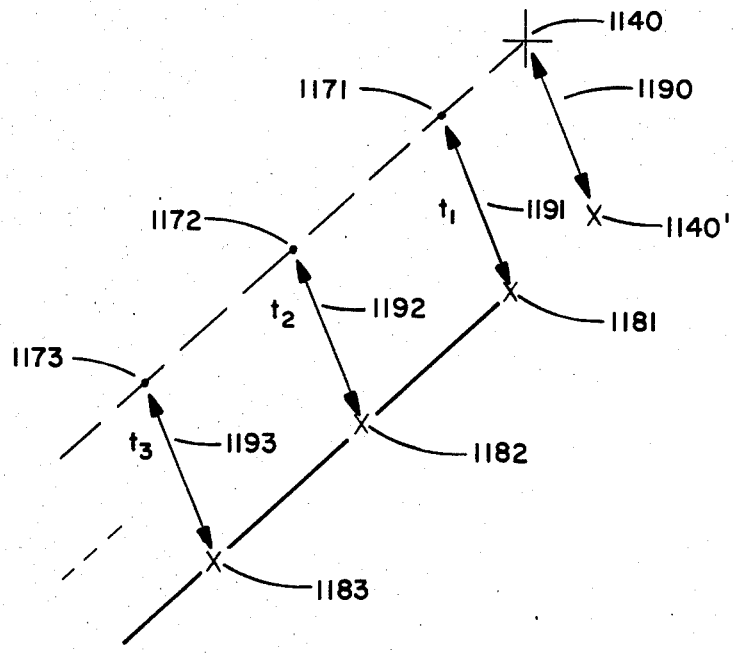
FIG. 12 shows, in more detail, a portion of FIG. 11.

Another non-iterative method of solution that may be programmed in the preferred embodiment of the invention is shown in FIGS. 11 and 12, whereby the aircraft need be flown in any selected constant maneuver during the error-correction process. This method predicts the time and position of the bullets' centroid based upon the aircraft maneuver and compares it to the time and the bullets' centroid position measured and computed by this system. For each such time, e.g. for time $t_1$, the actual bullet position 1171 and the predicted bullet position 1181 are compared and the relative error 1191 in the form of a vector is determined.

The relative error vectors 1191, 1192, 1193, etc. may be averaged and the resultant error vector 1190 may be used to correct the boresight position 1140. Averaging is not necessary by this method, but is available and will yield a better solution.

Figure 13:
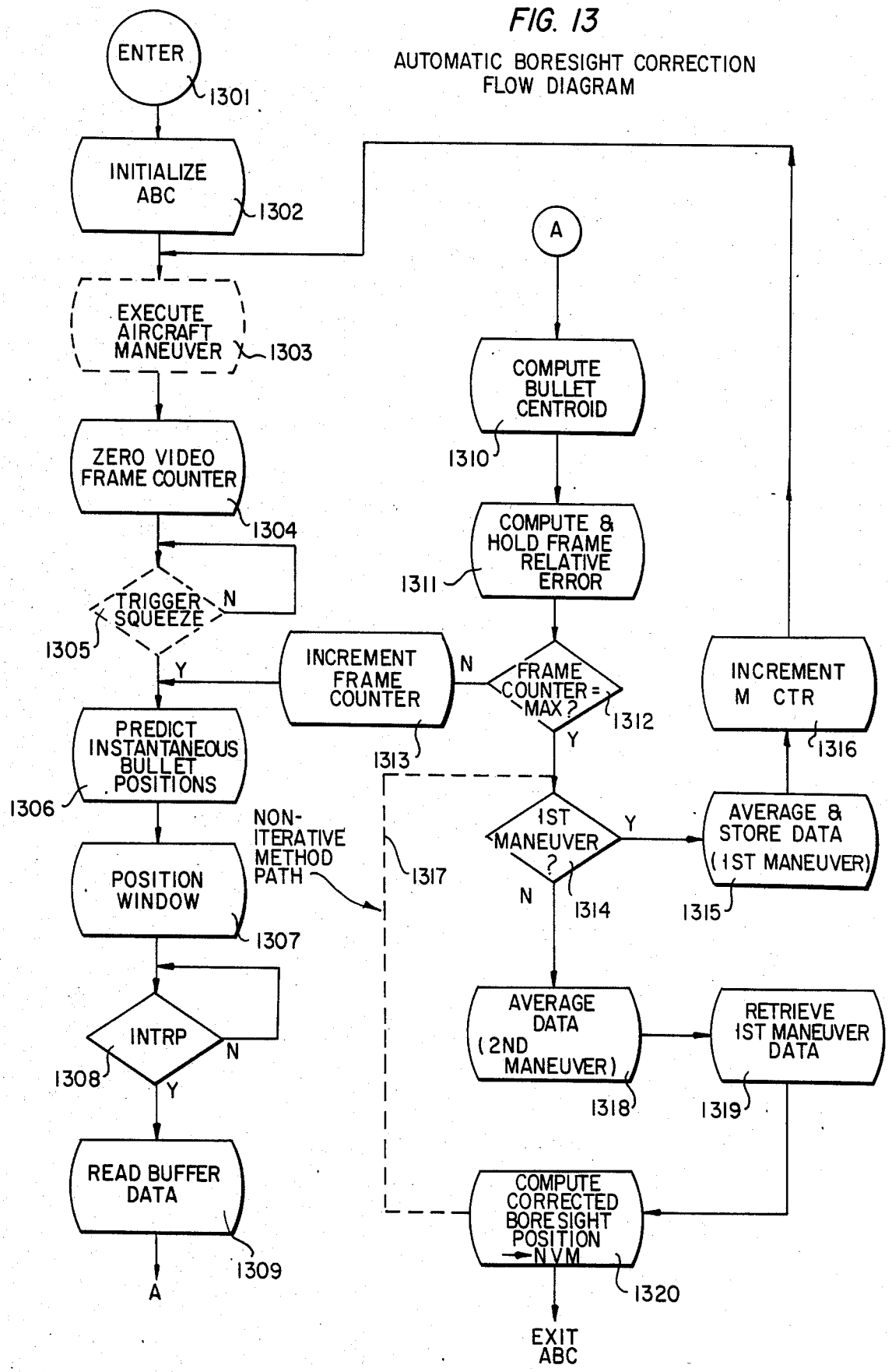
FIG. 13 shows, in flow diagram form, the steps for calculating the boresight error.
Figure 14:
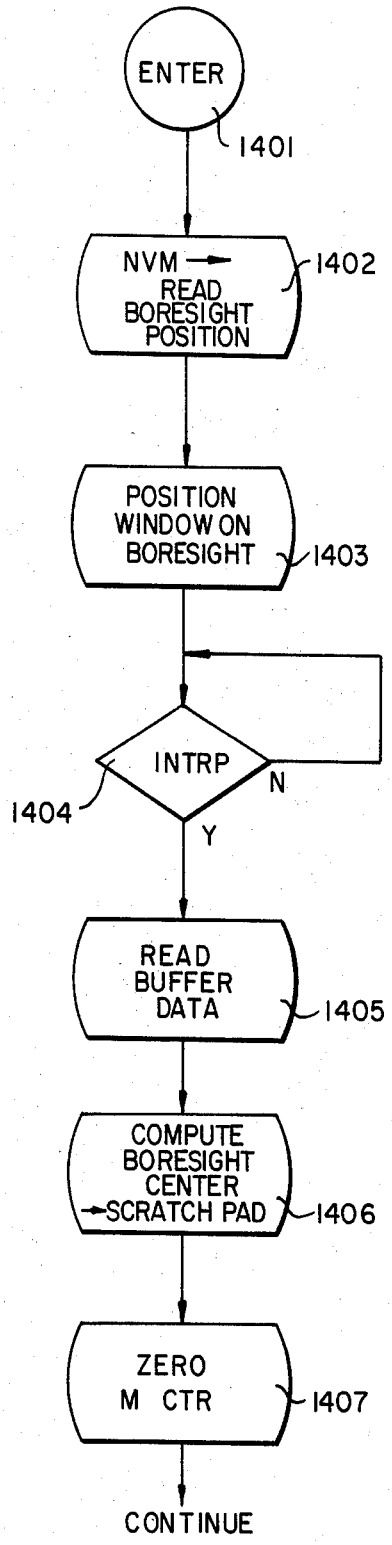
FIG. 14 shows an expansion of a portion of the flow diagram of FIG. 13.

FIGS. 13 and 14 jointly constitute a functional flow diagram for the relative error processing software used by CPU 34 to calculate the corrected boresight position. The sighting system is placed into the automatic boresight correction (ABC) routine when the pilot selects the ABC mode with mode selector switch 42. At this time, digital processor 35 branches to the ABC software routine stored in program memory 38. The major sequence of events is shown on the flow diagram of FIG. 13.

Upon entry at block 1301, the system is initialized for ABC, as illustrated by block 1302. This is shown in more detail by the portion of the flow diagram of FIG. 14. The previously computed boresight position is read from non-volatile memory (NVM), as shown in block 1402, and is used to compute and position the window on the expected position of the boresight cross, as illustrated by block 1403. With the window positioned on the expected boresight position, digital processor 35 waits for the CTVS raster to scan through the window and issue an interrupt (INTRP) as shown by block 1404. When it does, the data is read from memories 208 and 209 of video processing section 36, as indicated by block 1405. The center of the newly measured boresight position is then computed, as shown by block 1406, and stored in scratch pad memory 33 for further use. Next, a maneuver counter (MCTR) is cleared to zero as shown by block 1407.

While these events are in progress, the pilot executes the aircraft maneuver described in the preferred embodiment, as illustrated by block 1303 of FIG. 13. Note that if the non-iterative method of the solution illustrated in FIGS. 11 and 12 is used, only one maneuver is required. In that case, the flow of the diagram in FIG. 13 would be as shown by the dotted line indicated at 1317. The maneuver itself and the trigger squeeze are not part of the software program. Thus, block 1303, which represents the maneuver, and block 1305, which represents the trigger squeeze, are shown dotted in the flow diagram. The maneuver represented by block 1303 may be performed any time before the trigger squeeze and thus block 1303 may be positioned anywhere before block 1305.

Referring now to FIG. 13, the frame (raster) counter is cleared to zero as shown by block 1304 and the system waits for the firing of the bullets (trigger squeeze) by the pilot. When the burst of bullets is fired, the estimated instantaneous bullet positions relative to the aircraft are computed for the maneuver the aircraft is then executing, as illustrated by block 1306. The position of the window is computed according to the expected position of the bullets for the first video frame, as shown by block 1307, and the computed boundaries are loaded into window generator 240 of video processing section 36. With the window positioned on the expected positions of the bullets, the digital processor now waits for the CTVS raster to scan through the window and issue an interrupt (INTRP), as indicated by block 1308. When it does, the data stored in memories 208 and 209, comprising the video processing section buffer, are read by the digital processor, as shown by block 1309. The centroid of the bullets is computed for this raster frame, as shown by block 1310, and the relative error is computed for this frame and stored in scratch pad memory 33, as indicated by block 1311.

The digital processor now has the data to process the relative error for this part of the aircraft maneuver. However, the bullets will still be visible for a number of succeeding frames and holding the aircraft in the maneuver for a short period of time is easy to accomplish. Therefore, the data may be refined and an average taken over an number of video frames by allowing the software to iterate correspondingly. Thus a test is performed in block 1312 to determine if the system has iterated over a predetermined number of video frames. If not, the system is caused to iterate through the next video frame. Before doing so the frame counter is incremented, as shown by block 1313.

The system iterates through a predetermined number of video frames, storing the data each time. Upon completion, when the frame counter equals the maximum count in 1312, the system detects that the first maneuver has been completed, as indicated by block 1314. The stored data is retrieved and averaged for all the frames of the first maneuver and is stored temporarily, as shown by block 1315. The maneuver counter is incremented as shown by block 1316, the video frame counter is zeroed as shown by block 1304, and the system waits for the pilot to execute the second maneuver, indicated by block 1303, and squeeze the trigger, as indicated by block 1305.

In the event that the non-iterative method of solution is used (FIGS. 11 and 12), only one maneuver is required. In that case, the flow of the diagram of FIG. 13 would be as shown by dotted line 1317. The updated (or corrected) position of the boresight symbol is computed and stored in non-volatile memory, as indicated by block 1320, for further use in computing weapon delivery solutions.

For the iterative method of solution, a second maneuver is executed and the sequence as described for the first maneuver is repeated while data for each video frame is collected. Again, when the frame counter equals maximum, the digital processor leaves the loop and tests for the first maneuver, as shown by block 1314. This time for result is NO, signifying that the second maneuver is in progress. The frame data is retrieved from store and averaged for all the frames of the second maneuver, as illustrated by block 1318. The data previously stored for the first maneuver is extracted from the store, as shown by block 1319, and is used with the data just collected for the second maneuver to compute the updated (corrected) position of the boresight symbol indicated by block 1320. The result is stored in non-volatile memory 39 for further use in computing weapon delivery solutions. This completes the ABC routine and the digital processor exits back to a system executive.

While an automatic aircraft gunnery boresight correction system and method for automatically boresighting such gunnery have been described in what is presently considered to be a preferred embodiment thereof, it will be apparent to those skilled in the art that various changes and modifications other than those discussed above may be made in the structure and in the instrumentalities utilized without departing from the true spirit and scope of the invention.

What is claimed is:

1. An automatic boresight correction system for use in an aircraft having a gunnery system and a sighting system therefor, comprising:

a head-up display for displaying a boresight symbol through said sighting system, said boresight symbol representing a reference point for the prediction for the instantaneous positions of bullets fired from said gunnery system;

a video sensor for producing a sequence of video signals representing the instantaneous positions of said bullets;

a display processor for generating positioning data for said boresight symbol, said display processor including a video processing section, means for coupling video signals to said processing section for processing and storing the video signals representative of the relative positions of said bullets and said boresight signal as detected by said video sensor;

said display processor further including a boresight symbol generator; means for coupling the boresight symbol positioning data generated by said display processor to said boresight symbol generator to position said boresight symbol in response thereto;

means for actuating said boresight system; and a digital processor in said display processor responsive to said actuating means for predicting the instantaneous positions of said bullets and for computing any error between said predicted and the instantaneous bullet positions sensed by said video sensor, said digital processor being further adapted to adjust the position of said boresight symbol data to compensate for said computed error.

2. The correction system of claim 1 wherein said digital processor includes a non-volatile memory for storing the adjusted position data for said boresight symbol.

3. The correction system of claim 1 wherein said digital processor is additionally responsive to the adjusted position data of said boresight symbol to perform weapon delivery computations for said gunnery system.

4. The correction system of claim 1 wherein said digital processor is additionally responsive to said computed error to perform weapon delivery computations for said gunnery system.

5. The correction system of claim 1 wherein said aircraft includes sensors for providing data to said digital processor representative of the instantaneous motion of said aircraft, said digital processor being responsive to said motion data for factoring said motion data into the computation of said predicted instantaneous bullet positions.

6. The correction system of claim 1 wherein said video sensor comprises a cockpit television camera, said camera including means for delivering a signal to said videa processing section representing bullet positions and said boresight symbol position on said head-up display.

7. The correction system of claim 6 wherein said video processing section includes means for extracting and separating the signals representing the positions of said boresight symbol and of said bullets from the received camera signal.

8. The correction system of claim 7 wherein said video processing section includes means for providing a predetermined electronic window substantially centered around said predicted instantaneous bullet positions, said window excluding the portions of said camera signal outside the window bounds;

whereby the time and memory required by said video processing section and said digital processor for processing said received camera signal are reduced.

9. The correction system of claim 1 wherein at least some of said bullets are tracer rounds optically detectable by said video sensor.

10. A method for boresighting a gunnery system in an aircraft having a sighting system including a boresight symbol, comprising the steps of:

firing several rounds from said gunnery system;

detecting the actual positions of said fired rounds relative to said boresight symbol;

predicting the position of said fired rounds relative to said boresight symbol;

computing an error vector representative of the difference between the predicted positions and the actual positions of said fired rounds; and correcting said sighting system to compensate for said difference according to said error vector.

11. The method of claim 10 wherein the step of predicting the positions of said fired rounds includes factoring in data representative of the instanteous motion of said aircraft.

12. The method of claim 11 wherein the step of detecting the actual positions of said fired rounds includes computing the centroid of a plurality of said fired rounds; and the step of computing said error vector includes comparing said computed centroid with a predicted centroid computed relative to said boresight symbol.

13. The method of claim 12 wherein the step of comparing said computed centroid further includes:

performing a comparison for each of a plurality of instantaneous positions of said computed centroid to the respective instantaneous predicted centroid positions.

14. The method of claim 13 wherein the step of correcting said sighting system further includes:

averaging said comparisons for said plurality of instantaneous positions; and moving the position of said boresight symbol in a direction adapted to reduce said error vector by an amount proportional to the average of said comparisons.

15. A method for automatically boresighting a gunnery system in an aircraft having a sighting system including a bore sight symbol comprising the steps of:

firing several rounds from said gunnnery system;

detecting the actual positions of said fired rounds relative to said bore sight symbol;

computing a predicted trajectory of said fired rounds relative to said bore sight signal;

computing an error vector representative of the difference between predicted positions and the actual positions of said fired rounds; and correcting said sighting systems to compensate for said difference according to said error vector.

16. The method of claim 15 wherein said aircraft is in flight and the step of detecting said actual trajectory of said fired rounds includes:

detecting the individual position of each fired round;

computing the centroid of a plurality of individual rounds;

computing the trajectory of said centroid; and comparing said computed trajectory of said centroid with said predicted trajectory computed relative to said boresight symbol.

17. The method of claim 16 wherein the step of computing the predicted trajectory of said fired rounds includes factoring in data representative of the instantaneous motion of said aircraft.

18. The method of claim 15 wherein said aircraft is in flight and the step of determining said error vector includes:

performing a series of in-flight iterative solutions, each solution determining a corresponding component of said error vector by comparing the actual trajectory to said predicted trajectory.

19. The method of claim 18 wherein the step of computing the predicted trajectory of said fired rounds includes factoring in data representative of the instantaneous motion of said aircraft.

20. The method of claim 19 wherein the step of correcting said sighting system includes:

moving the position of said boresight symbol in a direction to reduce said error vector by an amount proportional to the corresponding error vector component for each iterative solution.

21. The method of claim 19 wherein the step of computing the predicted trajectory of said fired rounds includes factoring in data representative of the instantaneous motion of said aircraft.

22. The method of claim 21 wherein the step of correcting said sighting system includes moving the position of said boresight symbol in a direction adapted to reduce said error vector by an amount proportional to each error vector component.

23. The method of claim 15 wherein the step of firing several rounds includes firing several tracer bullets to facilitate the detection of said fired rounds.

24. The method of claim 15 wherein said aircraft is in flight and the step of computing said error vector includes:

performing a first constant turn maneuver in one direction;

computing a first error component based on said first turn maneuver;

performing a second constant turn maneuver approximately perpendicular to said first turn manuever;

computing a second error component based on said second turn maneuver; and combining said first and second components to provide said error vector.

* * * * *